US005916008A

United States Patent [19]

Wong

[11] Patent Number: 5,916,008

[45] Date of Patent: Jun. 29, 1999

[54] WALL DESCENDING TOY WITH RETRACTABLE WHEEL AND COVER

[75] Inventor: Tak-Ko Wong, Hong Kong, The Hong Kong Special Administrative Region of the People's Republic of China

[73] Assignee: T. K. Wong & Associates, Ltd., The Hong Kong Special Administrative Region of the People's Republic of China

[21] Appl. No.: 09/090,441

[22] Filed: Jun. 4, 1998

[30] Foreign Application Priority Data

Jun. 20, 1997 [GB] United Kingdom ..... 9713125

[51] Int. Cl.[6] ..... A63H 18/14; A63H 17/00; A63H 17/26

[52] U.S. Cl. ..... 446/445; 446/431; 446/466

[58] Field of Search ..... 446/445, 431, 446/437, 439, 441, 465, 466, 470, 469, 279

[56] References Cited

U.S. PATENT DOCUMENTS

| | | | |
|---|---|---|---|
| 4,764,148 | 8/1988 | Wong | 446/431 |
| 4,892,503 | 1/1990 | Kumazawa | 446/437 X |
| 5,618,219 | 4/1997 | Simone et al. | 446/437 X |
| 5,746,641 | 5/1998 | Wong | 446/431 |

FOREIGN PATENT DOCUMENTS

| | | | |
|---|---|---|---|
| 900432 | 11/1953 | Germany | 446/437 |
| 55-78982 | 6/1980 | Japan | 446/431 |
| 2316013 | 2/1998 | United Kingdom . | |

*Primary Examiner*—D Neal Muir

*Attorney, Agent, or Firm*—Miller, Sisson, Chapman & Nash, P.C.

[57] ABSTRACT

A wall walker toy car has a wheel with a sticky undulating surface. The wheel is mounted on a pivotable bracket which provides a cover for an aperture in a base of the car. For wall-walking mode, the bracket is manually rotated so that the surface is partially exposed to engage a vertical surface. In the configuration shown in the Figure, the surface of the wheel is wholly inside the car and so cannot be contaminated with dust and debris.

3 Claims, 1 Drawing Sheet

WALL DESCENDING TOY WITH RETRACTABLE WHEEL AND COVER

BACKGROUND OF THE INVENTION

1. Field of the Invention

The invention relates to toys.

2. Description of Prior Art

The invention relates more particularly to "wall walker" toys that include one or more wheels having sticky peripheral surfaces. The toys may be in the form of cars, aeroplanes, cartoon characters and so forth that run on vertical or steeply inclined surfaces. The peripheral surfaces are often partly enveloped in a body of the car, aeroplane or cartoon character and exposed sufficiently to bear against the vertical surface during travel of the toy down the surface. Total or partial exposure leads to the sticky surface becoming easily spoiled and contaminated so as to be less useful, or even useless in due course, in holding the toy properly to the surface during use.

SUMMARY OF THE INVENTION

It is an object of the invention to overcome or at least reduce this problem.

According to the invention there is provided a wall walker toy having a sticky surfaced wheel mounted inside a body of the toy in a first position where its surface extends through an aperture in the body to be partially exposed outside the body, in which the wheel is movable to a second position where the wheel is positioned wholly within the body, and a pivotable cover for the aperture that supports the wheel to move between the first and second positions.

The pivotable cover is preferably formed with a stop that engages opposing ends of the aperture to retain the wheel in its first or second position respectively.

The pivotable cover is preferably manually movable from externally of the body to move the wheel between its first and second positions.

BRIEF DESCRIPTION OF THE DRAWINGS

A wall walker three-wheeled toy car according to the invention will now be described by way of example with reference to the accompanying drawings in which.

DESCRIPTION OF THE PREFERRED EMBODIMENTS

Figure 1:
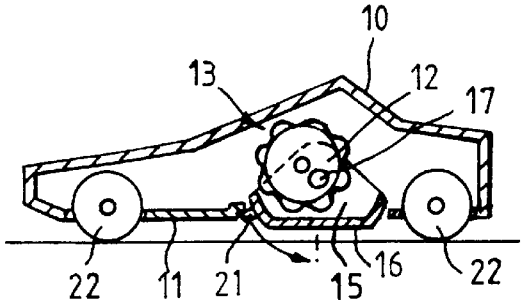
FIGS. 1 to 4 are diagrammatic sectioned side views of the car.
Figure 3:
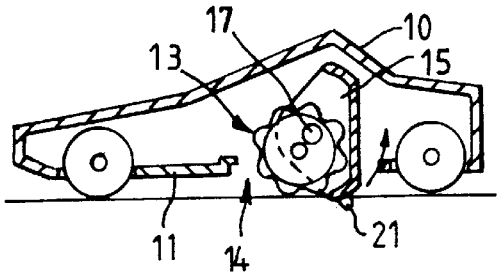
Figure 2:
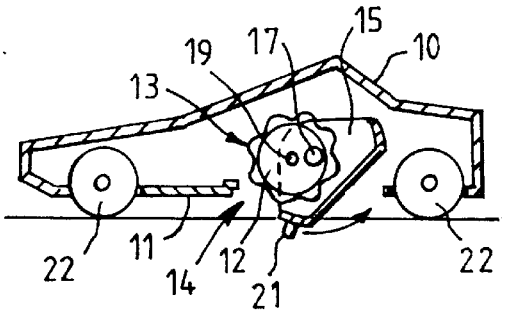
Figure 4:
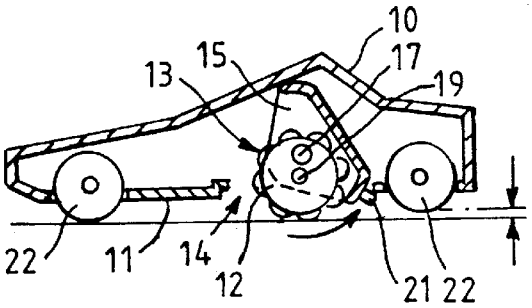

Referring to the drawings, in FIGS. 1 to 4 the car has a hollow body 10 closed by a base 11. A wheel 12 has an undulated sticky peripheral surface 13 and is mounted inside the body. The wheel 12 has a first operative position shown in FIG. 1 and a second operative position shown in FIG. 4.

In the first position the wheel is wholly inside the body and in the second position the wheel is partly exposed outside the body 10 extending through an aperture 14 in the base 11.

Figure 5:
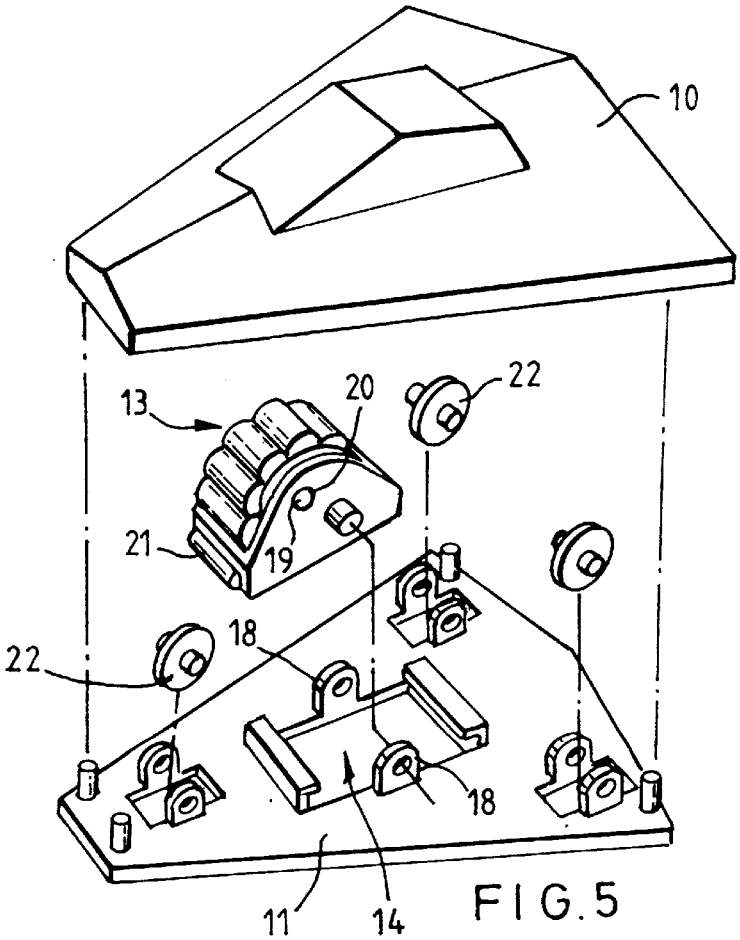
FIG. 5 is an exploded isometric view of the car to a large scale.

The wheel 12 is supported by pivotable bracket 15 providing a rectangular cover 16 for the aperture 14 in FIG. 1. The bracket is mounted by integrally formed stub axles 17 (see FIG. 5) to upstanding axle supports 18 on the base 11. The wheel 12 has an axle 19 that is held in opposing apertures 20 suitably displaced from the axis of the axles 17 and formed in the bracket 15. A single stop 21 is provided at one side of the bracket 15 that constrains rotation of the bracket, when the stop abuts either of opposite ends of the aperture 14, to retain the wheel 12 in its first or second operative position respectively. The toy has three wheels 22 (best seen in FIG. 5) that are supported and attached to the base 11.

Referring again to FIGS. 1 to 4, it can be seen by looking at these Figures in turn how the wheel 12 is moved in sequence from its first position to its second position. It can be seen clearly in FIGS. 1 to 4 how the stop 21 prevents over-rotation of the bracket 15. If preferred, the edges of the aperture may be formed to springy or partially receive the stop 21 so that it "clicks" to the edges of the aperture to be retained against casual disengagement. In the configuration shown in FIG. 1, the car can be used in a conventional manner supported to run on its wheels 22, whereas in the configuration shown in FIG. 4 the toy will travel down a vertical or steeply inclined surface in the manner of a "wall-walker". As such when the toy is used conventionally, or stored for example, the cover 16 effectively closes off the aperture 14 to prevent dust and debris entering the body 10 and, as the wheel 12 is then fully retracted and inside the body, the sticky surface 13 will not be contaminated.

Suitable materials for the sticky surface 13 include a sticky gelatinous composition, such as a melt blend admixture of poly (styrene-ethylene-butylene-styrene) triblock copolymer and plasticising oils.

We claim:

1. A wall walker toy having a sticky surfaced wheel mounted inside a body of the toy in a first position where its surface extends through an aperture in the body to be partially exposed outside the body, in which the wheel is movable to a second position where the wheel is positioned wholly within the body, and a pivotable cover for the aperture that supports the wheel to move between the first and second positions.

2. A wall walker toy according to claim 1, in which the pivotable cover is formed with a stop that engages opposing ends of the aperture to retain the wheel in its first or second position respectively.

3. A wall walker toy according to claim 1, in which the is pivotable cover is manually movable from externally of the body to move the wheel between its first and second positions.

* * * * *